US012005308B1

(12) United States Patent
Stearns et al.

(10) Patent No.: US 12,005,308 B1
(45) **Date of Patent: *Jun. 11, 2024**

(54) CLIMBING EXERCISE APPARATUS

(71) Applicants: Kenneth W Stearns, Houston, TX (US); Joseph D Maresh, West Linn, OR (US)

(72) Inventors: Kenneth W Stearns, Houston, TX (US); Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/944,388

(22) Filed: Sep. 14, 2022

Related U.S. Application Data

(63) Continuation of application No. 16/984,121, filed on Aug. 3, 2020, now Pat. No. 11,458,358.

(60) Provisional application No. 62/881,367, filed on Aug. 1, 2019.

(51) Int. Cl.
*A63B 22/20* (2006.01)
*A63B 22/00* (2006.01)

(52) U.S. Cl.
CPC ..... *A63B 22/205* (2013.01); *A63B 22/001* (2013.01); *A63B 2022/0043* (2013.01)

(58) Field of Classification Search
CPC .. A63B 22/0046; A63B 22/0002–0007; A63B 22/001; A63B 22/0012–0017; A63B 22/025; A63B 22/04; A63B 2022/002; A63B 2022/0028; A63B 2022/0038–0043; A63B 2022/0092; A63B 21/4033–4035; A63B 21/4045; A63B 23/03575; A63B 23/03516; A63B 23/03533; A63B 23/03591
See application file for complete search history.

(56) References Cited

U.S. PATENT DOCUMENTS

| | | | | |
|---|---|---|---|---|
| 5,040,785 | A * | 8/1991 | Charnitski | A63B 22/205 482/52 |
| 5,090,690 | A * | 2/1992 | Huang | A63B 22/0005 482/52 |
| 6,135,923 | A * | 10/2000 | Stearns | A63B 23/03583 482/52 |
| 11,458,358 | B1 * | 10/2022 | Stearns | A63B 22/001 |
| 2018/0304116 | A1 * | 10/2018 | Ho | A63B 22/205 |
| 2020/0171346 | A1 * | 6/2020 | Chen | A63B 22/205 |
| 2020/0376332 | A1 * | 12/2020 | Silver | A63B 22/001 |

* cited by examiner

*Primary Examiner* — Loan B Jimenez
*Assistant Examiner* — Kathleen M Fisk
(74) *Attorney, Agent, or Firm* — Nick A. Nichols, Jr.

(57) ABSTRACT

An exercise apparatus having multiple exercise modes of operation may include a frame supporting generally vertically oriented reciprocating members spaced apart and in substantial parallel relationship to one another. Reciprocating leg members may include foot supports secured at the lower distal ends thereof. Reciprocating arm members may include hand grips coupled proximate the upper distal ends of the arm members. The arm members and leg members may be operably coupled in multiple configurations for a user to perform various climbing exercise movements.

7 Claims, 9 Drawing Sheets

CLIMBING EXERCISE APPARATUS

CROSS-REFERENCE TO RELATED APPLICATION

This application is a continuation of U.S. patent application Ser. No. 16/984,121, filed Aug. 3, 2020, which claims priority to and the benefit of the filing date of U.S. Provisional Application Ser. No. 62/881,367, filed Aug. 1, 2019, which applications are herein incorporated by reference in their entirety.

BACKGROUND

The present invention relates to fitness equipment, more particularly to exercise apparatus where the exercise paths are substantially vertical and parallel to each other.

During exercise machine climbing activities two coordinated body movements are generally possible. A first motion may be referred to as homolateral movement where an asymmetrical movement of the upper limb and the lower limb on the same side occurs, and a second motion referred to as contralateral movement where a diagonal movement of an upper limb with the opposite lower limb occurs. The first motion of homolateral movement or straight climbing is more closely correlated with martial arts where martial arts typically employ homolateral movements, whereas the second motion of asymmetrical or cross climbing action is more closely correlated with oppositional exercises such as swimming and walking. In homolateral motion the body halves do not cooperate but move separately, and in contralateral motion both sides of the brain function at the same time in a coordinated manner.

SUMMARY

An exercise apparatus having multiple exercise modes of operation may include a frame supporting generally vertically oriented reciprocating members spaced apart and in substantial parallel relationship to one another. Reciprocating leg members may include foot supports secured at the lower distal ends thereof. Reciprocating arm members may include hand grips coupled proximate the upper distal ends of the arm members. The arm members and leg members may be operably coupled in multiple configurations for a user to perform various climbing exercise movements.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
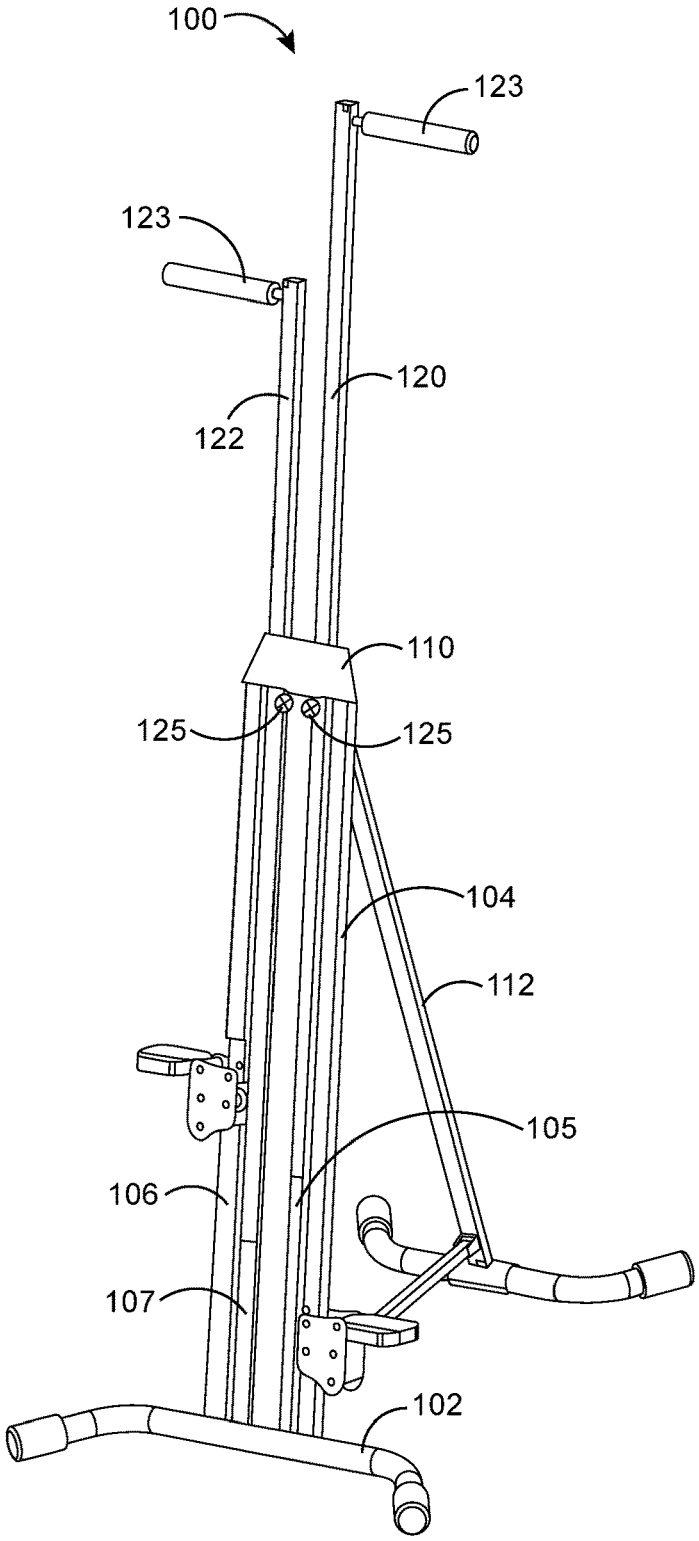
FIG. 1 is a partially broken away perspective view of a climbing exercise apparatus.

Referring first to FIG. 1, a cross-climbing exercise apparatus is generally identified by the reference numeral 100. The exercise apparatus 100 may include a frame (partially illustrated in some of the drawings) that supports the exercise apparatus 100 at a generally vertical orientation. The frame may include a base 102 supporting the exercise apparatus 100 on a generally flat surface. Track or guide members 104, 105, 106 and 107 may be fixedly secured to the base 102 and extend generally vertically upward from the base 102 at an angle of about fifteen (15°) degree from vertical. The guide members 104, 105, 106, 107 may be spaced apart and parallel relative to one another. A transverse frame member or bridge member 110 may bridge the space separating the guide members 104, 105, 106, 107 at the upper distal ends thereof, thereby fixedly connecting the guide members 104, 105, 106, 107 to one another and maintaining the spacing between them. An angularly extending frame member or stanchion 112 may have one end fixedly secured to the base 102 and an opposite end fixedly secured to the transverse frame member 110.

The guide members 104, 106 may include a channel or race 109 for slidably receiving leg members 114 and 116, respectively. The leg members 114, 116 may include foot platforms 118 movably or fixedly secured proximate the lower distal ends of respective leg members 114, 116.

The guide members 105, 107 may include a channel or race 111 for slidably receiving arm members 120 and 122, respectively. Hand grips 123 may be fixedly secured proximate the upper distal ends of arm members 120, 122. The leg members 114, 116 and arm members 120, 122 may reciprocate relative the guide members member 104, 105, 106, 107 on rollers or slide members and the like known in the art.

Figure 2:
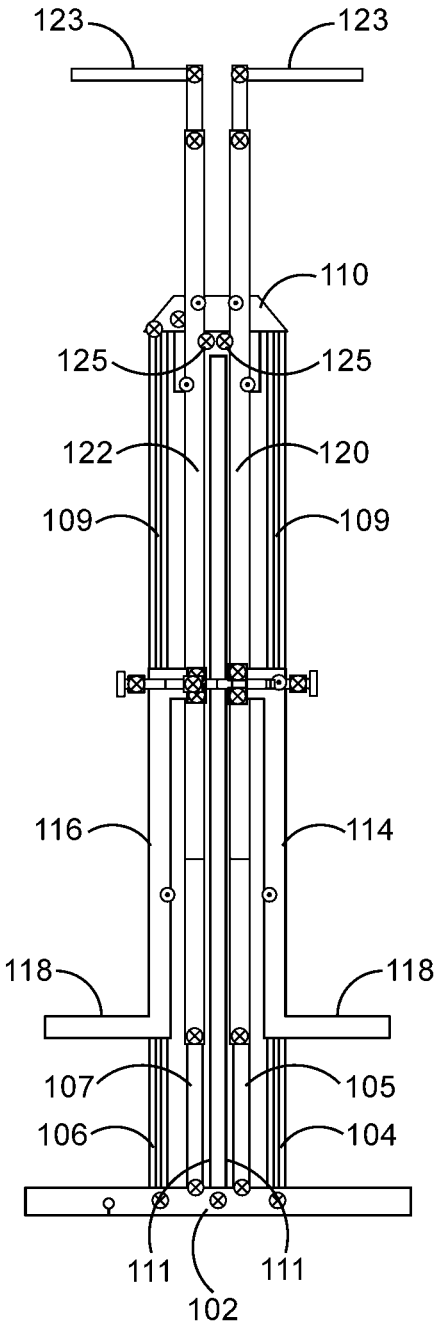
FIG. 2 is a partially broken away front view of the climbing exercise apparatus shown in FIG. 1 with some supporting structure removed illustrating an initial position of the handlebars and foot supports.

The climbing exercise apparatus 100 may include a pulley or sprocket rotatably supported by the frame. A cord, cable, rope, belt, chain and the like passing over the pulley or sprocket may connect the leg members 114, 116 to maintain synchronized movement of the leg members 114, 116 and arm members 120, 122. Two or more pulleys 125, illustrated in FIG. 2, may be employed in configurations of the climbing exercise apparatus 100 where both arm members 120, 122 are connected to reciprocally move in the same direction with one or the other of the leg members 114, 116, respectively, or where the arm members 120, 122 may move independent of the leg members 114, 116 and independent from each other.

Figure 3:
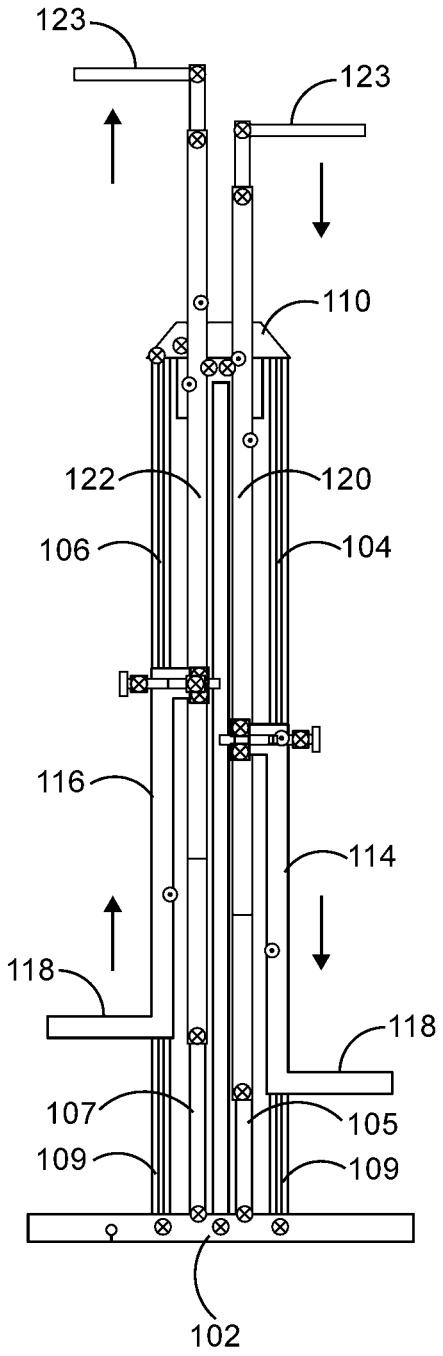
FIG. 3 is a partially broken away front view of the climbing exercise apparatus shown in FIG. 1 with some supporting structure removed illustrating the straight climbing mode configuration.
Figure 8:
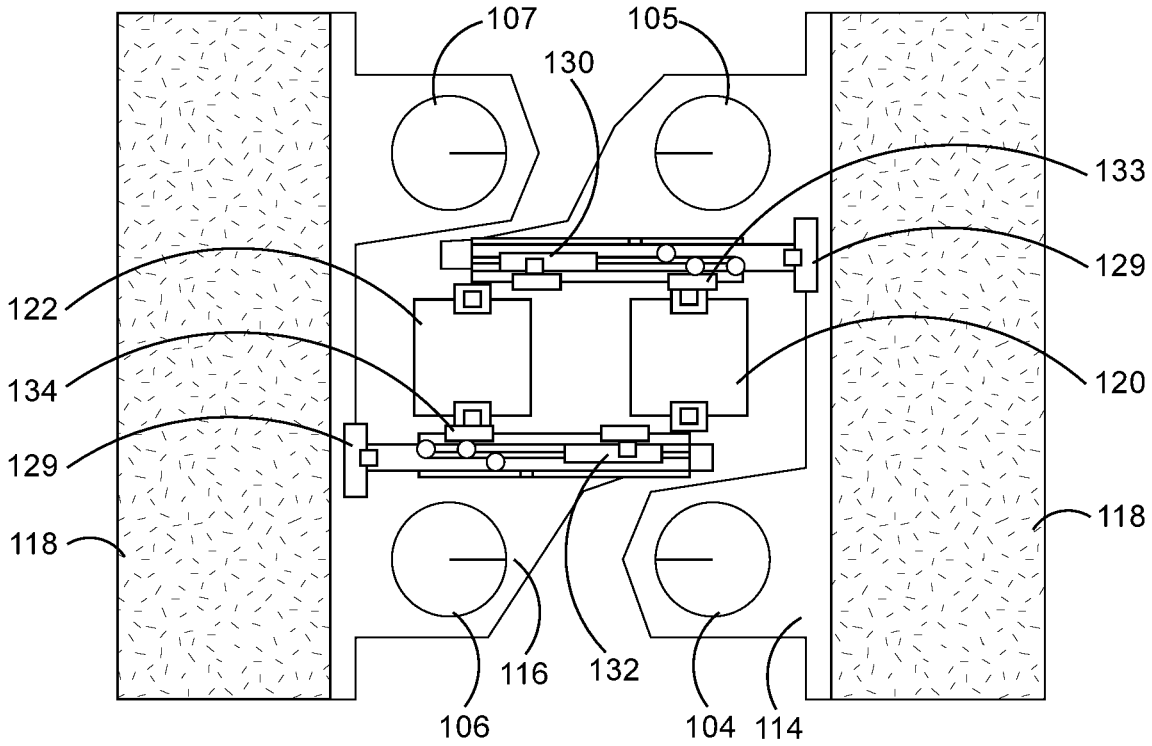
FIG. 8 is a partially broken away section view of the climbing exercise apparatus shown in FIG. 1 with some supporting structure removed illustrating slide switches connecting the foot platforms to the respective handlebars in the straight climbing mode configuration.
Figure 9:
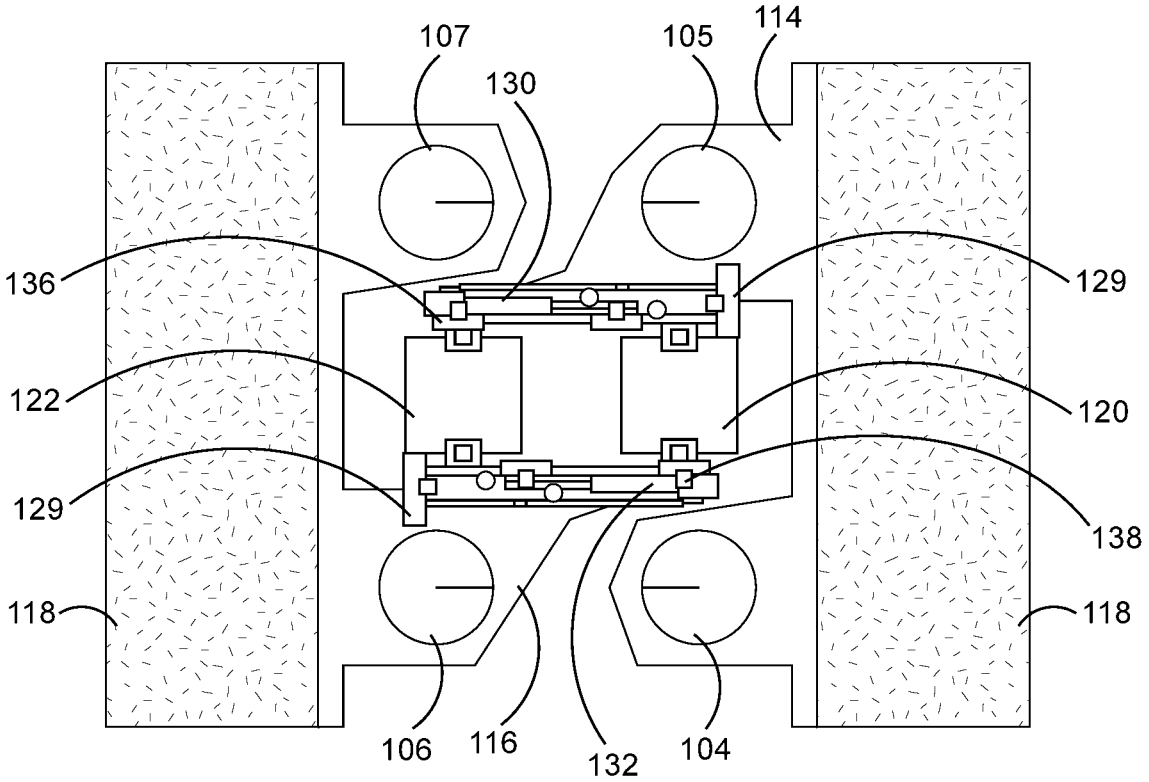
FIG. 9 is a partially broken away section view of the climbing exercise apparatus shown in FIG. 1 with some supporting structure removed illustrating slide switches connecting the foot platforms to the respective handlebars in the cross-climbing mode configuration.

Referring now to FIGS. 8 and 9, actuators 129, generally shown as boxes in FIGS. 8 and 9, may be employed to selectively connect the leg members 114, 116 and arm members 120, 122 in combinations or configurations for a desired mode of operation of the climbing exercise apparatus 100. For illustrative purposes only and without limitation, the actuators 129 may be operatively connected to slide switches 130 and 132. In FIG. 8, the slide switches 130, 132 connect the leg members 114, 116 to respective arm members 120, 122 to operate the climbing exercise apparatus 100 in the straight climbing exercise mode. That is, slide switch 130 is shown connecting right leg member 114 to right arm member 120. The slide switch 130 may cause a pin and the like to connect the right leg member 114 and right arm member 120 at a connection point 133 so that they move in the same reciprocal direction. Likewise, the slide switch 132 causes a pin and the like to connect the left leg member 116 to the left arm member 122 at a connection point 134 so that they move in the same reciprocal direction. The straight climbing exercise mode of operation of the climbing apparatus 100 is illustrated in FIG. 3.

Figure 4:
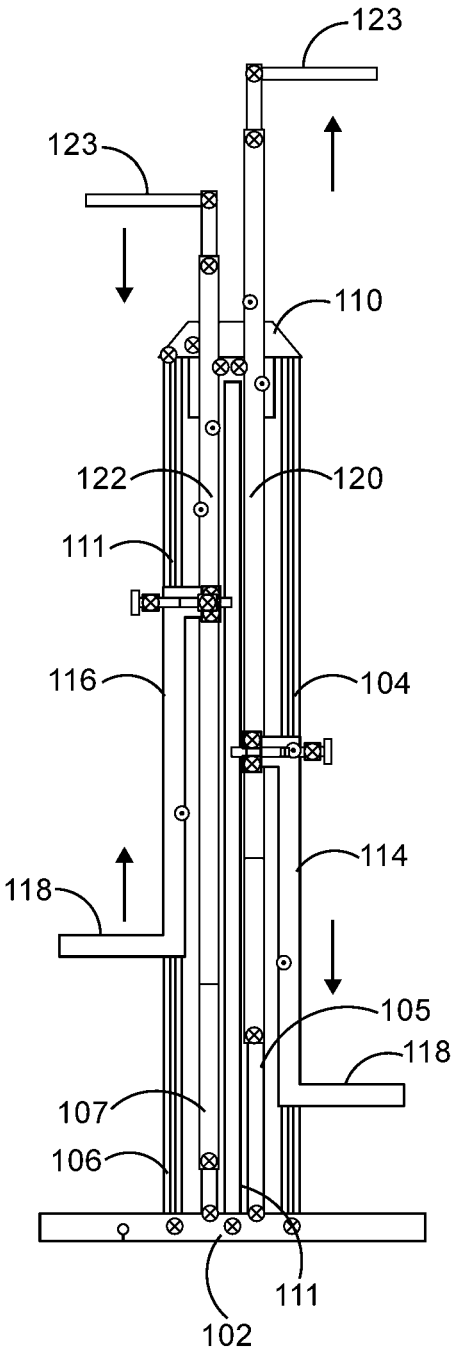
FIG. 4 is a partially broken away front view of the climbing exercise apparatus shown in FIG. 1 with some supporting structure removed illustrating the cross-climbing mode configuration.

FIG. 9 illustrates activation of the actuators 129 to position the slide switches 130, 132 for operating the climbing exercise apparatus 100 in the cross-climbing or contralateral exercise mode. Switch 130 is illustrated connecting the right leg member 114 to the left arm member 122 at connection point 136. Switch 132 connects the left leg member 116 to the right arm member 120 at a connection point 138 so that they move in the same reciprocal direction. The cross-climbing exercise mode of operation of the climbing exercise apparatus 100 is illustrated in FIG. 4.

Figure 5:
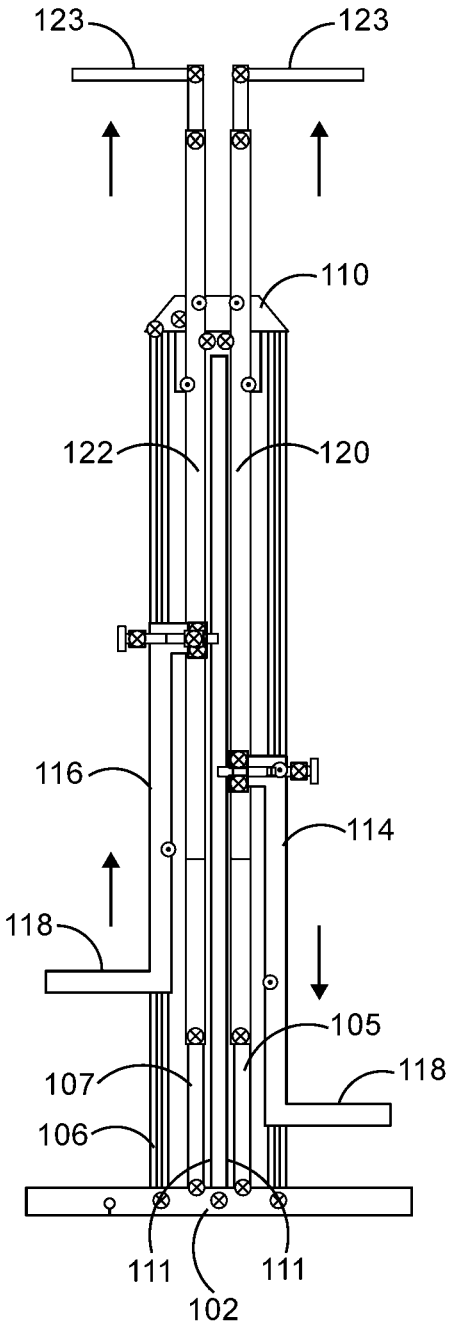
FIG. 5 is a partially broken away front view of the climbing exercise apparatus shown in FIG. 1 with some supporting structure removed illustrating both handlebars and the left foot platform moving in the same direction.

In FIG. 5, a third exercise mode of the climbing exercise apparatus 100 is illustrated. In the third exercise mode, the actuator 129 connects the left leg member 116 to both arm members 120, 122. It may be observed that in the third exercise mode of the climbing exercise apparatus 100, the left leg member 116 and both arm members 120, 122, move in the same reciprocal direction while the right leg member 114 moves in the opposite direction.

Figure 6:
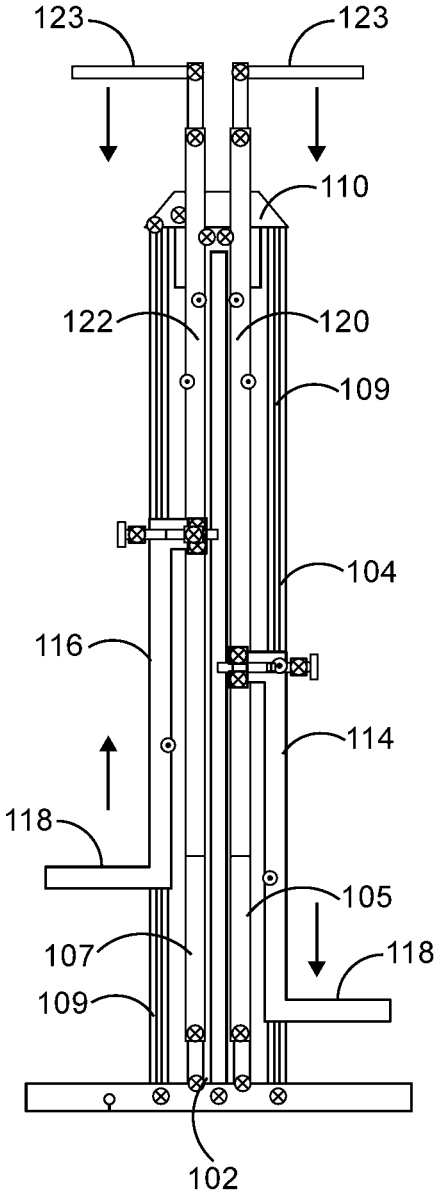
FIG. 6 is a partially broken away front view of the climbing exercise apparatus shown in FIG. 1 with some supporting structure removed illustrating both handlebars and the right foot platform moving in the same direction.

In FIG. 6, a fourth exercise mode of the climbing apparatus 100 is illustrated. In the fourth exercise mode, the right leg member 114 may be connected to both arm members 120, 122. In the fourth exercise mode, the right leg member 114 and arm members 120, 122, move in the same reciprocal direction while the left leg member 116 moves in the opposite direction.

Figure 7:
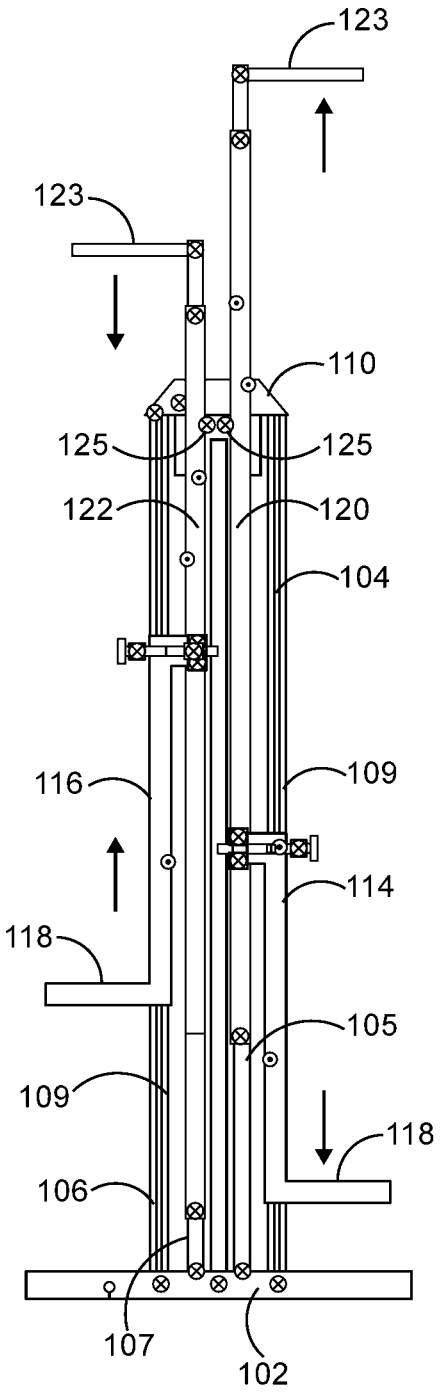
FIG. 7 is a partially broken away front view of the climbing exercise apparatus shown in FIG. 1 with some supporting structure removed illustrating an independent mode configuration where the handlebars are not connected to either the left or right foot platforms.

In FIG. 7, a fifth exercise mode of the climbing apparatus 100 is illustrated. In the fifth exercise mode, neither the left nor the right leg members 114, 116, are connected to arm members 120, 122. In this exercise mode, the left and right arm members 120, 122 and left and right leg members 114, 116 move independent of each other. The fifth exercise configuration may include two or more pulleys or sprockets 125 to facilitate independent movement of the arm members 120, 122 and leg members 114, 116, permitting a user to move his/her legs and arms at various speeds and movement combinations, such as but not limited to, changing the speed of the upper body exercise versus the lower body or changing the range of motion of the upper body versus the lower body and the like.

It is understood that the switch mechanisms illustrated in FIGS. 8 and 9 is not limited to slide switches. The switch mechanisms may be a rotary switch, independent individual switches, knife switches, solenoids, clutch plates, connection knobs and the like. The actuators 129 may interface may with a suitable interface device, such as but not limited to, a cell phone or a display mounted to the climbing exercise apparatus 100 and the like.

While preferred embodiments of the invention have been shown and described, other and further embodiments of the invention may be devised without departing from the basic scope thereof, and the scope thereof is determined by the claims which follow.

The invention claimed is:

1. An exercise apparatus, comprising:

a) a frame;

b) guide members extending vertically upward in a spaced apart relationship to one another fixedly secured to said frame;

c) a pair of elongated leg members and a pair of elongated arm members, each of said pair of leg members and each of said pair of arm members movably coupled to respective said guide members, and each of said pair of leg members including a foot platform secured to a proximal end thereof, and each of said of arm members including a hand grip secured proximate to a distal end thereof; and d) actuators operatively connected to slide switch connectors actuable to selectively interconnect said pair of arm members to said pair of leg members.

2. The exercise apparatus of claim 1 wherein said actuators are operatively connected to an interface device.

3. The exercise apparatus of claim 1 wherein said pair of leg members are configured to selectively and respectively connect to said pair of arm members to form at least five exercise configurations.

4. An exercise apparatus, comprising:

a) a frame including a base;

b) a plurality of guide members fixedly secured to said base extending vertically upward in spaced apart relationship to one another;

c) a left leg member and a right leg member each movably coupled to a respective one of said plurality of guide members;

d) a left arm member and a right arm member each movably coupled to a respective one of said plurality of guide members;

e) actuators operable to selectively change exercise configurations; and f) slide switches operable to connect said left and right leg members to said left and right arm members to form multiple exercise configurations.

5. The exercise apparatus of claim 4 wherein said actuators are operatively connected to an interface device.

6. The exercise apparatus of claim 4 wherein said left and right leg members are configured to selectively connect to said left and right arm members to form a plurality of exercise configurations.

7. The exercise apparatus of claim 4 wherein said actuators are operable to disengage said left and right arm members and respective said left and right leg members permitting independent movement of said left and right arm members and said left and right leg members relative to one another.

* * * * *